US006274825B1

(12) United States Patent
Aaltonen et al.

(10) Patent No.: US 6,274,825 B1
(45) Date of Patent: Aug. 14, 2001

(54) KEYPAD ASSEMBLY

(75) Inventors: A. Aaltonen; J. Mehtonen, both of Salo (FI); T. Ala-Lehtimäki, Coppell, TX (US)

(73) Assignee: Nokia Mobile Phones Limited, Espoo (FI)

( * ) Notice: Subject to any disclaimer, the term of this patent is extended or adjusted under 35 U.S.C. 154(b) by 0 days.

(21) Appl. No.: 09/331,668

(22) PCT Filed: Dec. 24, 1997

(86) PCT No.: PCT/IB97/01600

§ 371 Date: Sep. 28, 1999

§ 102(e) Date: Sep. 28, 1999

(87) PCT Pub. No.: WO98/28763

PCT Pub. Date: Jul. 2, 1998

(30) Foreign Application Priority Data

Dec. 24, 1996 (GB) ..... 9626895
Oct. 10, 1997 (GB) ..... 9721500

(51) Int. Cl.[7] ..... H01H 13/70
(52) U.S. Cl. ..... 200/5 A; 200/517
(58) Field of Search ..... 200/5 R, 5 A, 200/117 R, 18, 512, 517, 520, 292, 296, 341, 344, 345; 400/472, 473, 490, 491.2, 495, 495.1, 496

(56) References Cited

U.S. PATENT DOCUMENTS

| | | | | |
|---|---|---|---|---|
| 4,005,293 | | 1/1977 | Boulanger | 200/5 A |
| 4,046,975 | | 9/1977 | Seeger | 200/5 A |
| 4,092,527 | * | 5/1978 | Luecke | 364/709 |
| 5,579,002 | * | 11/1996 | Iggulden et al. | 341/23 |
| 5,668,358 | * | 9/1997 | Wolf et al. | 200/5 A |
| 5,734,137 | * | 3/1998 | Wakefield | 200/5 A |

FOREIGN PATENT DOCUMENTS

| | | | |
|---|---|---|---|
| 0340967 | 11/1989 | (EP) | H01H/13/70 |
| 0340967A2 | 11/1989 | (EP) | H01H/13/70 |
| 0531973 | 3/1993 | (EP) | H01H/13/70 |
| 0531973A2 | 3/1993 | (EP) | H01H/13/70 |
| 2079061 | 6/1981 | (GB) | H01H/13/52 |
| 2079061A | 1/1982 | (GB) | H01H/13/52 |
| 2115982 | 2/1983 | (GB) | H01H/5/04 |
| 2115982A | 9/1983 | (GB) | H01H/13/70 |

* cited by examiner

*Primary Examiner*—Michael A. Friedhofer
(74) *Attorney, Agent, or Firm*—Antonelli, Terry, Stout & Kraus, LLP

(57) ABSTRACT

A method and apparatus for constructing assemblies for keypads with different key layouts using substrates each having the same pattern of electrical-contact regions formed thereon and domed contact elements. In the invention, a first design of key layouts is selected, a first insulating layer having a plurality of apertures dependent on the first design are provided, and the domed contact elements are mounted to confront corresponding electrical-contact regions of a first of the substrates with the first insulating layer disposed therebetween. Each of the apertures are in register with the domed contact element to thereby produce an assembly having the first design of a key layout. Further, in the invention a second design of a key layout is selected, where the second design of a key layout is different from the first design of a key layout, a second insulating layer having a plurality of apertures dependent on the second design of a key layout is provided; and the domed contact elements are mounted to confront corresponding electrical-contact regions of a second of the substrates with the second insulating layer disposed therebetween. Each of the apertures are in register with a domed contact element to thereby produce an assembly having the second design of a key layout.

18 Claims, 7 Drawing Sheets

Fig.(7b).

KEYPAD ASSEMBLY

BACKGROUND OF THE INVENTION

The present invention relates to the design and structure of an assembly for a keypad having particular, but not exclusive, application to the field of mobile phones.

Market forces require that mobile phone manufacturers produce an ever-increasing variety of mobile phones. In order to benefit from economies of scale and to minimize design effort for a particular model of mobile phone, it is advantageous to make use of components, wherever possible, which are common to a range of models.

SUMMARY OF THE INVENTION

One aspect, the present invention provides a method of constructing assemblies for keypads with different key layouts using substrates each having the same pattern of electrical-contact regions formed thereon and domed contact elements. The method includes the steps of selecting a first design of key layout; providing a first insulating layer having a plurality of apertures dependent on the first design; and mounting the contact elements to confront corresponding electrical-contact regions of a first of said substrates with the first insulating layer disposed therebetween. Each of the apertures being registered with a contact element, thereby to produce an assembly having the first design key layout. The method further includes the steps of; selecting a second design of key layout, the second design being different to the first key layout; providing a second insulating layer having a plurality of apertures dependent on the second design; and mounting the contact elements to confront corresponding electrical-contact regions of a second of the substrates with the second insulating layer disposed therebetween, each of said apertures being register with a contact element, thereby to produce an assembly having the second design key layout.

This design methodology allows a substrate having a standard pattern of electrical contact regions to be used for a range of keypad designs having different key spacings. For each design, a customised insulating layer is used.

In another aspect, the present invention provides an assembly for a keypad, which includes: a substrate having a plurality of electrical-contact regions, each region being defined by a first electrical terminal and a second electrical terminal; an array of domed contact elements, the elements being mounted to confront a corresponding electrical-contact region and overlie only a portion thereof; an insulating layer disposed between the substrate and the contact elements and including a plurality of apertures, each aperture corresponding to an electrical-contact region, each element being depressible from a first natural bias position to a second distorted position in which a summit portion of the element passes through its corresponding aperture to contact its corresponding electrical-contact region, thereby to establish electrical connection between the first and second terminals of the corresponding electrical-contact region.

This structure of assembly for a keypad allows a substrate having a particular pattern of electrical-contact regions to be used for a range of keypad designs having different key spacings. It will be appreciated that this is achieved because, in one design, each contact element overlies a portion of the corresponding electrical-contact regions, whereas, in another design, each contact element can overlie a different portion of the corresponding electrical-contact region—thereby to provide for different key spacings.

Preferably, the area enclosed by the electricai-contact region is greater (preferably substantially greater) than the footprint area of the dome of the corresponding contact element. Advantageously, the former area is between 1.5 and 3 times the latter area. Preferably, the former area is approximately twice the latter area. The greater the area of the electrical-contact region relative to the footprint of the dome of the corresponding contact element, the more flexibility there is in locating the corresponding contact element.

In accordance with the invention, the eletrical connection between the first and second terminals can be achieved through 'edge connection' or 'centre connection'. in edge connection, when electrical contact between the first and second terminals is achieved, a section of the rim of a contact element and its summit portion contact the first and second terminals, respectively. In centre connection, the summit portion alone of a contact element provides contacts closely-spaced first and second terminals.

In accordance with the invention, examples of edge connection and centre connection can be included in a single keypad assembly design.

In a still further aspect the present invention provides an assembly for a keypad including an array of domed contact elements, a substrate having a plurality of electrical-contact regions, the contact elements being mounted so as to confront a corresponding electrical-contact region, each contact element being depressible so as to snap from a natural-bias position in which it does not contact the corresponding electrical-contact region to a distorted position in which a summit portion of the contact element contacts the corresponding electrical-contact region, wherein each contact element overlies only a portion of the corresponding electrical-contact region.

Exemplary embodiments of the invention are hereinafter described with reference to the accompanying drawings, in which:

Figure 1:
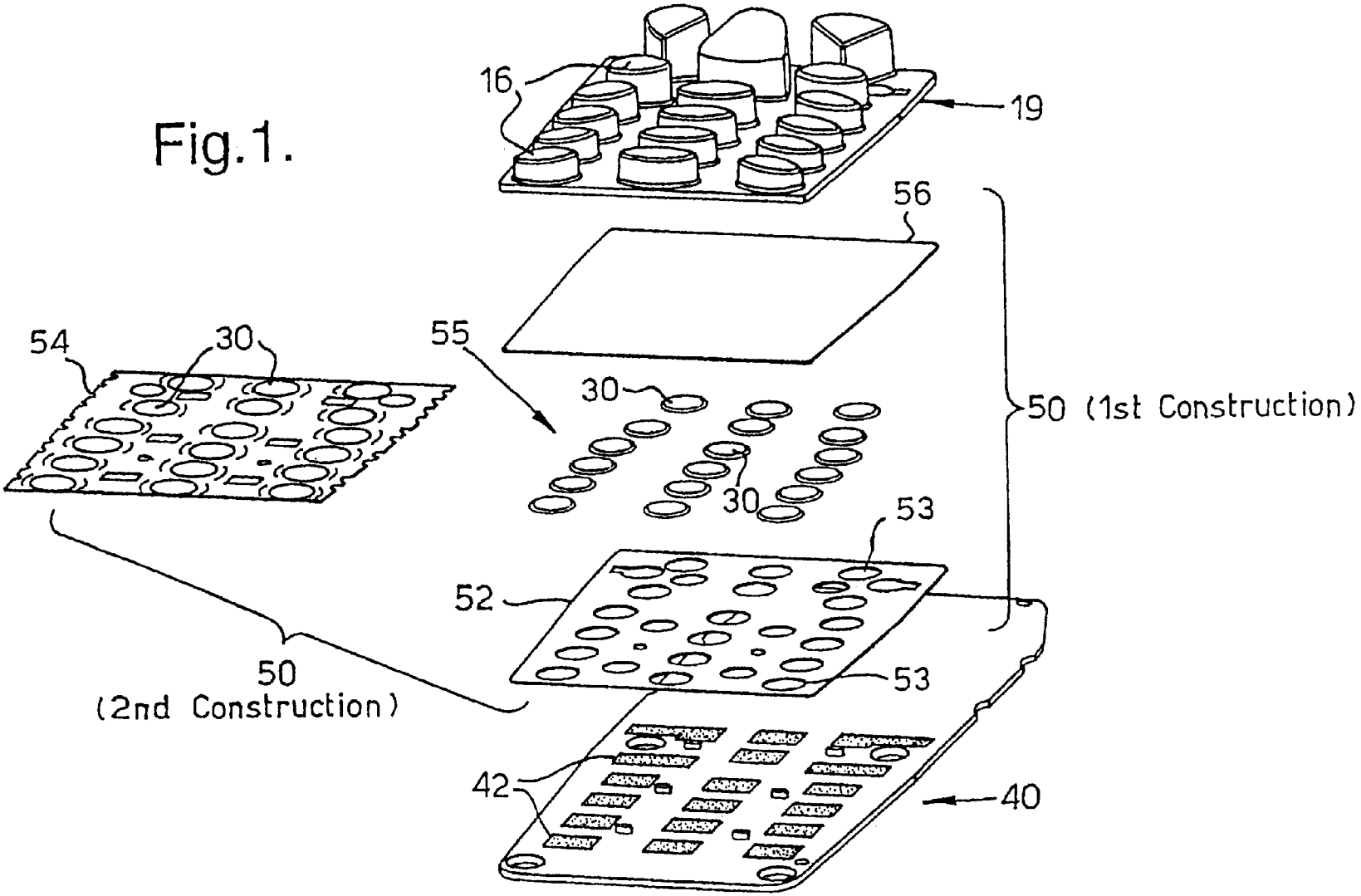
FIG. 1 shows an exploded view of first and second constructions of the invention.

Constructions of two alternative constructions for a keypad are illustrated in FIG. 1. In both constructions, a contact membrane 50 is sandwiched between a keymat 10 having a body portion 12 on which depressible keys 16 are mounted and a circuit board 40 having electrical-contact regions 42, each region 42 corresponding to one of the Ikeys 16. The contact membrane 50 provides an array of domed contact elements made from metal. Each contact element, designated by reference numeral 30, is arranged to lie intermediate a key 16 and its corresponding electrical-contact region 42. The two alternative constructions differ only in the structure of the contact membrane 50.

DETAILED DESCRIPTION OF THE INVENTION

In the first construction, the contact membrane 50 comprises an insulating sheet 52 to which is applied a one-piece metal dome sheet 54.

In the second construction, the contact membrane 50 comprises an insulating sheet 52 to which is applied a layer of adhesive tape 56 having an array of metal contact elements 30 individually adhered thereto.

In each construction, the insulating sheet 52 includes apertures 53 which align with a corresponding contact element 30. The insulating sheet 52 serves to electrically insulate the dome sheet 54, including its contact elements 30, from the electrical-contact regions 42 in the case of the first construction, and serves to electrically insulate the contact elements 30 from the electrical-contact regions in the case of the second construction. In both cases, the apertures 53 permit the contact elements 30 to make and break electrical contact with the electrical-contact regions 42 as illustrated in FIGS. 2(*a*) and 2(*b*).

Figure 2A:
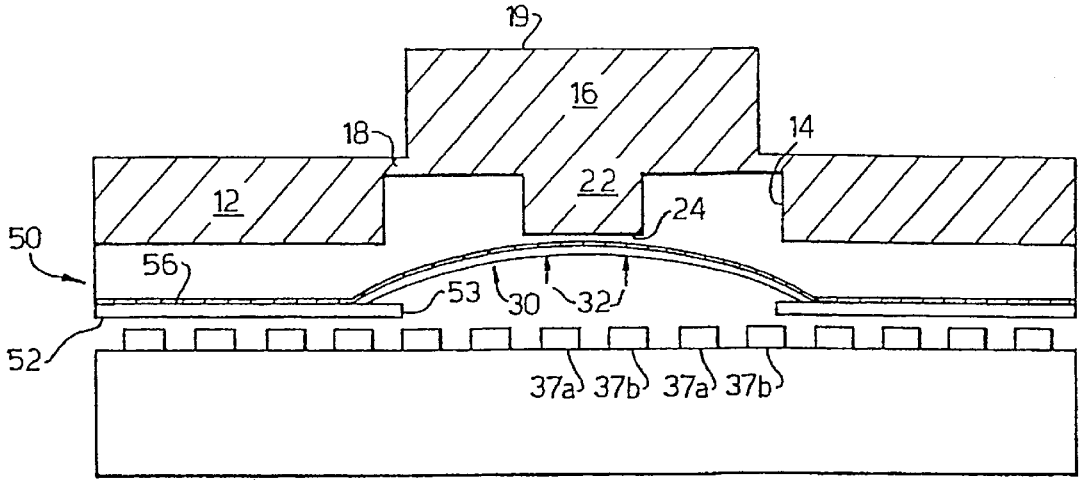
FIGS. 2(*a*),(*b*) show cross-sectional views of part of the second construction of the invention illustrating it in use.
Figure 2B:
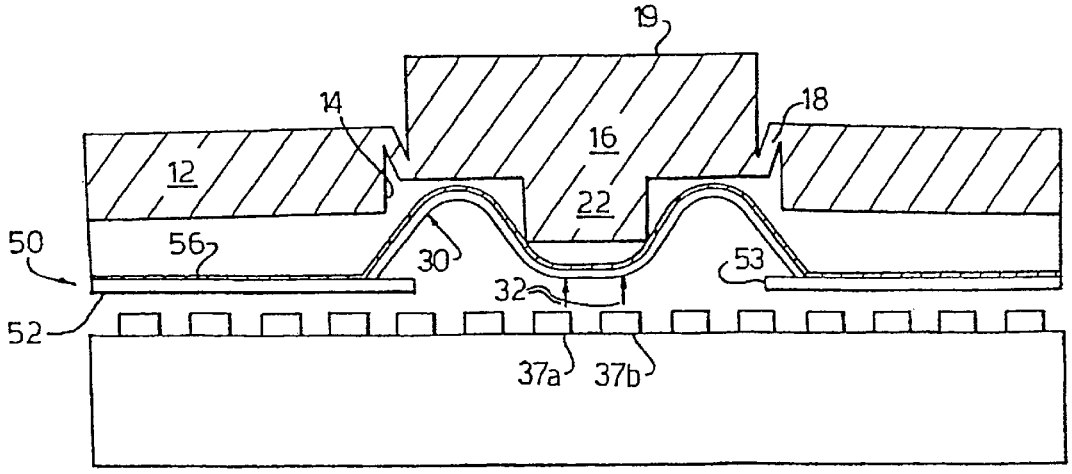

FIGS. 2(*a*) and 2(*b*) illustrate the operation of a single key 16 of a keypad in accordance with the second construction. The key 16 is mounted relative to the body portion 12 by means of a skirt region 18 which is flexible and permits the downward movement of the key 16 as shown in FIG. 2(*a*) when it is depressed, but naturally biases it to occupy the position shown in FIG. 2(*a*). On their upper surfaces, the key 16, the body portion 12 and the skirt region 18 can be painted; the upper surface of the key 16 includes an indicia region 19 which is painted so as to bear an indicia serving to indicate the function of the key 16, for example, an alphanumeric character or other symbol. The key 16 includes a base 20 from which a depending projection or pip 22 centrally projects. The pip 22 is cylindrical and has an exposed end 24. The key 16, including the pip 22, the body portion 12 and the skirt region 18 are made from a single piece of silicon rubber. The contact element 30 is insulated from the underlying circuit board 40, as shown in FIG. 2(*a*), by the insulating sheet 52. (it will be appreciated that the circuit board 40 is shown separated from the contact membrane 50 only for ease of illustration.) Again, as shown in FIG. 2(*a*), the keymat 10 is mounted such that a small spacing exists between the exposed end 24 and that part of the adhesive layer 56 covering a summit portion 32 of the contact element 30.

On the circuit board 40 in the electrical-contact region 42 beneath the key 16, a pair of electrical terminals 36*a*, 36*b* are formed. The terminals form a grid 35 of intermingled, but unconnected tracks, and are best seen (in plan) in FIG. 3. The electrical terminals 36*a*, 36*b* each comprise a plurality of parallel branch tracks 37*a*, 37*b*. The branch tracks 37*a*, 37*b* are arranged in an evenly-spaced row with the branch tracks of the electrical terminal 36*a* parallel and in alternating succession with that of the electrical terminal 36*b*. The electrical terminals 36*a*, 36*b* also comprise main tracks 38*a*, 38*b* which connect to an end of all of the respective branch tracks 37*a*, 37*b*. The main tracks 37*a*, 37*b* are spaced from and parallel to each other. Thus, any two neighbouring branch tracks 37*a*, 37*b* form part of different electrical terminals 36*a*, 36*b*.

The contact element 30 is distortable so as to snap from a first natural-bias position in FIG. 2(*a*), in which the electrical terminals 36*a*, 36*b* are not electrically connected to each other to a second distorted position, as shown in FIG. 2(*b*), in which the summit portion 32 of the contact element 30 provides electrical connection between adjacent branch tracks 37*a*, 37*b* of the electrical terminals 36*a*, 36*b*. in FIG. 2(*b*), the summit portion 32 is illustrated as contacting only two adjacent branch tracks 37*a*, 37*b*. In other embodiments, the summit portion 32 can be larger and contact more than two branch tracks 37*a*, 37*b* when the contact element 30 is in its distorted position.

Figure 3:
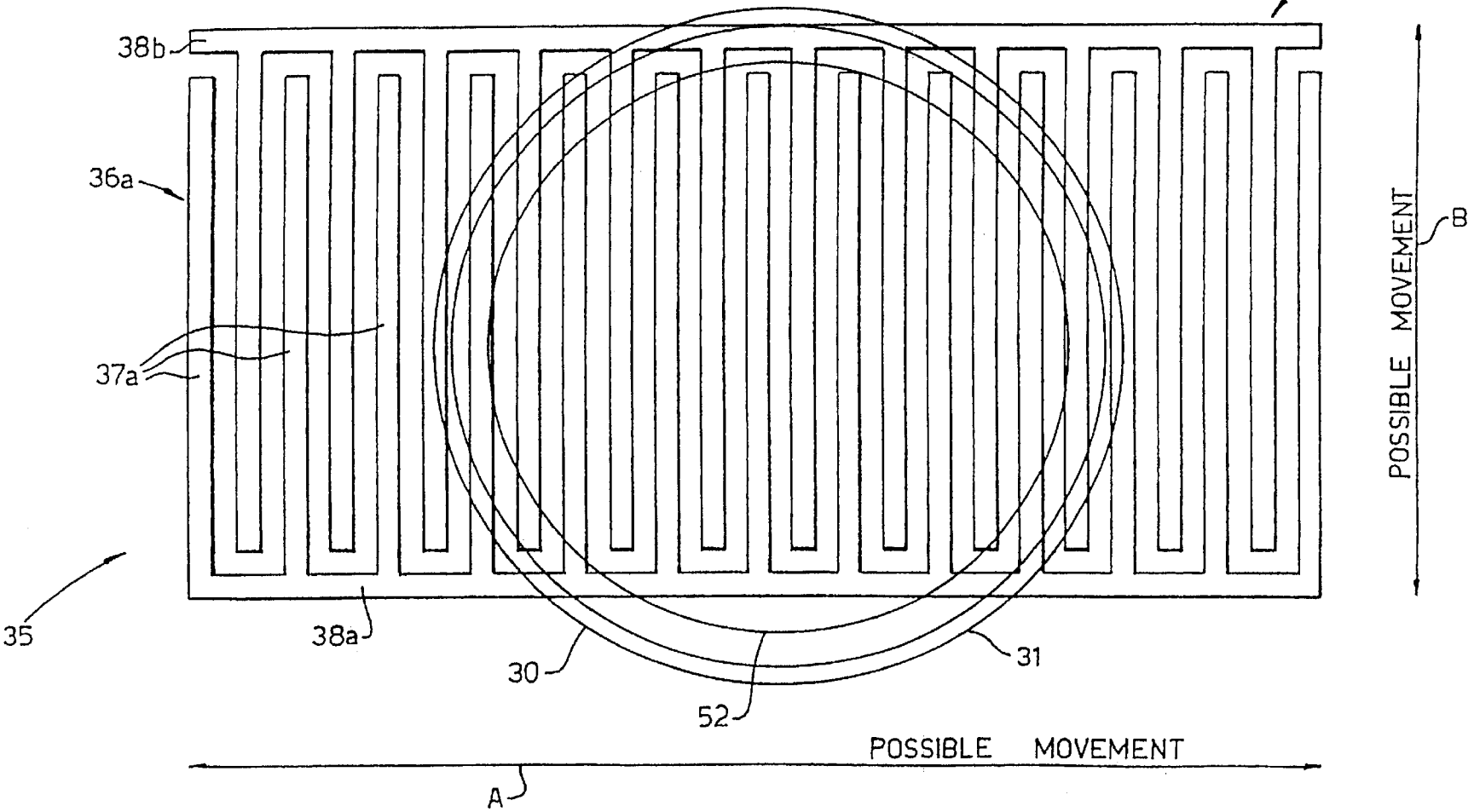
FIG. 3 shows a plan view of the domed contact element and electrical-contact region depicted in FIG. 2(*a*)

As can be seen in FIG. 3, the area of the grid 35 is substantially greater than the area enclosed by the rim 33 of the base of the contact element 30. As a result and as illustrated by arrows A and B, this enables the contact element 30 to be positioned in a wide variety of mounting locations overlying a portion of the corresponding electrical-contact region 42.

In use, the user depresses the Ikey 16 causing it to travel downward and thus the exposed end 24 of the pip 22 to bear against the adhesive layer 56 attached to the contact element 30. The continued travel of the pip 22 causes the continued distortion of the contact element 30, until it reaches a condition at which it snaps into the second position shown in FIG. 2(*b*). The making of the electrical connection between the electrical terminals 36*a*, 36*b* enables external circuitry (not shown) to register the depression of the key 16. When the key 16 is released, the resilience of the contact element 30 propels the key 16 upwardly and the contact element 30 resumes its first position as shown in FIG. 2(*a*). The resilience of the skirt region 18, then causes the key 16 to re-adopt its position in FIG. 2(*a*).

In other embodiments, the adhesive layer 56 can include an array of apertures (not shown) which allow pips 22 to act directly on the summit portions 32 of the contact elements 30.

The operation of a keypad in accordance with the first construction is not illustrated as its performance in use is the same as the second construction.

Figure 4:
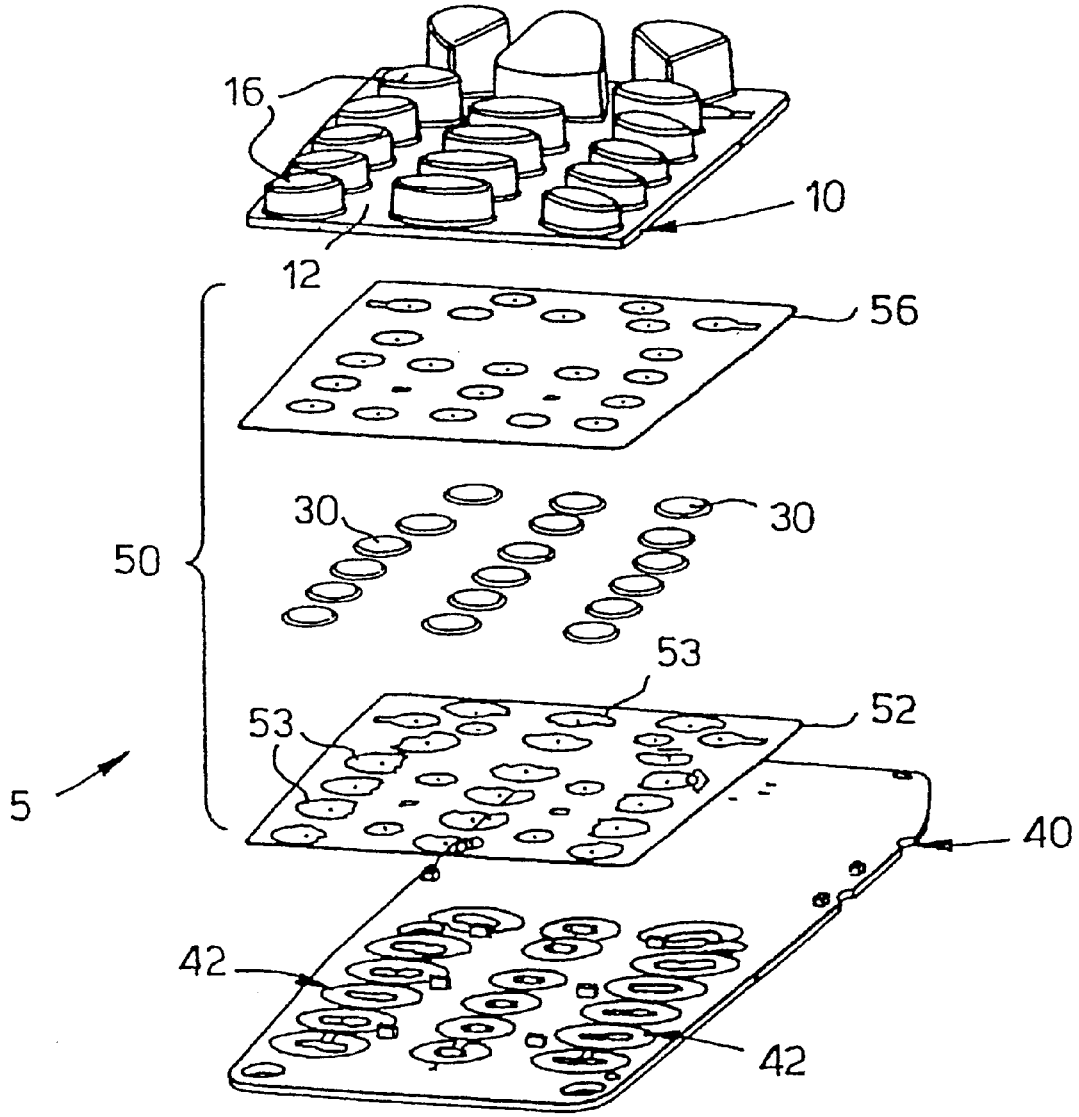
FIG. 4 shows an exploded view of a third construction of the invention.

A third construction for a keypad 5 is illustrated, in exploded form, in FIG. 4. Where similar parts of the third construction are similar to analogous parts in the first or second constructions, the same reference numerals have been used. In this construction, a contact membrane 50 is sandwiched between a keymat 10 having a body portion 12 on which depressible keys 16 are mounted and a circuit board 40 having electrical-contact regions 42, each region 42 corresponding to one of the keys 16. The contact membrane 50 provides an array of domed contact elements made from metal. Each contact element, designated by reference numeral 30, is arranged to lie intermediate a key 16 and its corresponding electrical-contact region 42. The contact membrane 50 comprises an insulating sheet 52 to which is applied a layer of adhesive tape 56 having the array of the metal contact elements 30 individually adhered thereto. The insulating sheet 52 includes apertures 53 which are arranged to align with a portion of the corresponding contact element 30.

Figure 5A:
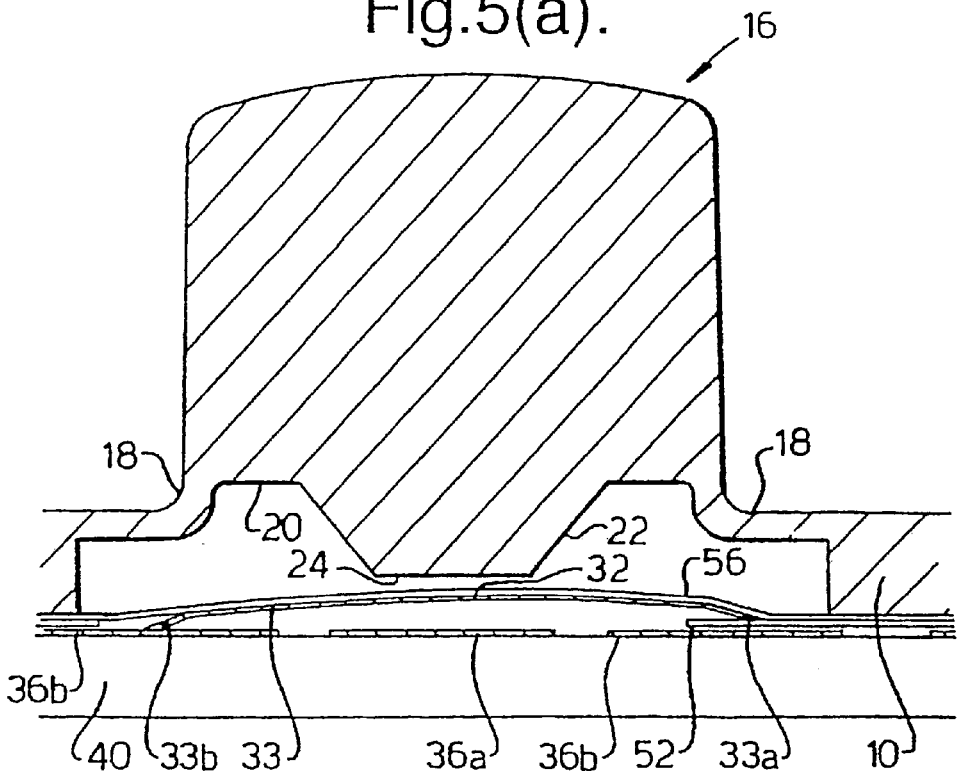
FIGS. 5(*a*), (*b*) show cross-sectional views of part of the third construction of the invention illustrating it in use.
Figure 5B:
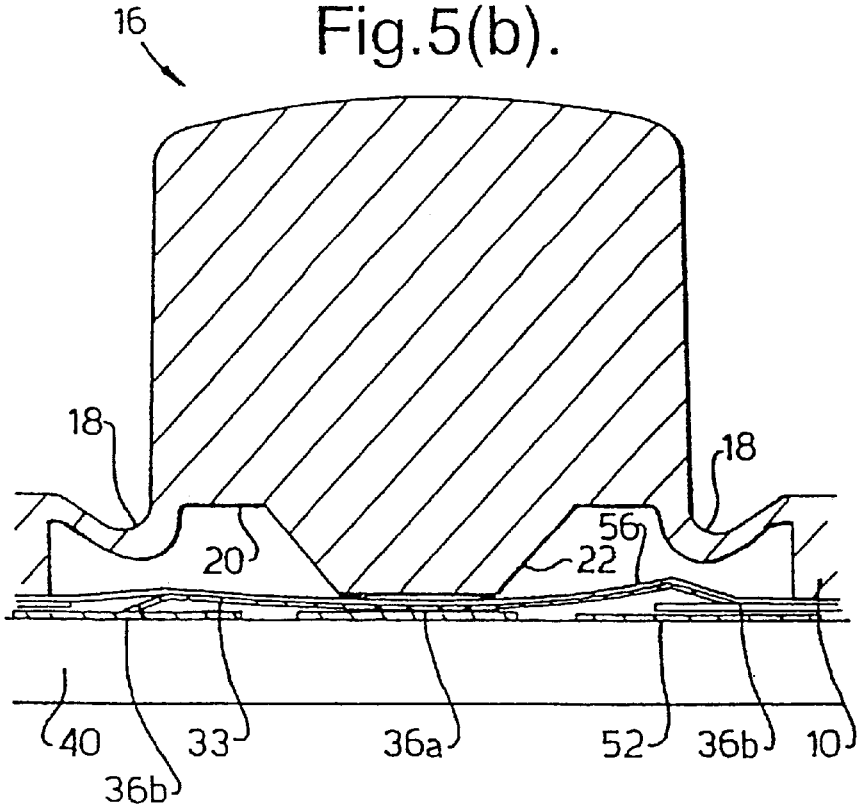

FIGS. 5(*a*) and 5(*b*) illustrate the operation of a single key 16 of the keypad 5. The key 16 is mounted relative to the body portion 12 by means of a skirt region 18 which is flexible and permits the downward movement of the key 16 as shown in FIG. 5(*b*) when it is depressed, but naturally biases it to occupy the position shown in FIG. 5(*a*). The key 16 includes a base 20 from which a depending projection 22 centrally projects. The projection 22 is frusto-conical and has an exposed end 24. The key 16, including the projection 22, the body portion 12 and the skirt region 18 are made from a single piece of silicon rubber. The apertures 53 in the insulating sheet 52 are shaped such that a first section 33*a* of the rim 33 of the base of the contact element 30 is insulated from the electrical contact regions 42 on the underlying circuit board 40 and a second section 33*b* of the rim 33 of the base of the contact element 30 is in contact with the electrical-contact regions 42 on the underlying circuit board 40. The keymat 10 is mounted as shown in FIG. 5(*a*) such that a small spacing exists between the exposed end 24 and that part of the adhesive layer 56 covering a summit portion 32 of the contact element 30.

On the circuit board 40 in the electrical-contact region 42 beneath the key 16, a pair of electrical terminals or pads 36*a*, 36*b* are formed. The terminals 36*a*, 36*b* are best seen (in plan) in FIG. 6(*b*). It will be seen from FIG. 6(*b*) that the terminal or outer pad 36*b*, substantially surrounds the terminal or the inner pad 36*a*. Electrical connection of the inner pad to the rest of the circuitry is made possible by a conductor 37*a* which passes through a gap 37*b* formed in the outer pad.

In use, the user depresses the key 16 causing it to travel downward and thus the exposed end 24 of the projection 22 to bear against the adhesive layer 56 attached to the contact element 30. This causes the second section 33*b* of the rim 33 of the contact element 30 to make positive electrical connection with the outer pad 36*b*. (In the FIG. 5(*a*) position, the second section 33*b* of the rim 33 of the contact element 30 may be in vague/unreliable electrical connection with the outer pad 36b or, alternatively, held slightly displaced therefrom by the adhesive layer 56). The continued travel of the projection 22 causes the further distortion of the contact element 30, until it reaches a condition at which it snaps into the second position shown in FIG. 5(*b*), at which point the summit portion 32 maces positive electrical connection with the inner pad 36*a*. The making of the electrical connection between the pads 36*a*, 36*b* enables external circuitry (not shown) to register the depression of the key 16. When the key 16 is released, the resilience of the contact elements 30 propels the key 16 upwardly and the contact element 30 resumes its first position as shown in FIG. 5(*a*). The resilience of the skirt region 18, then causes the key 16 to re-adopt its position in FIG. 5(*a*).

Figure 6A:
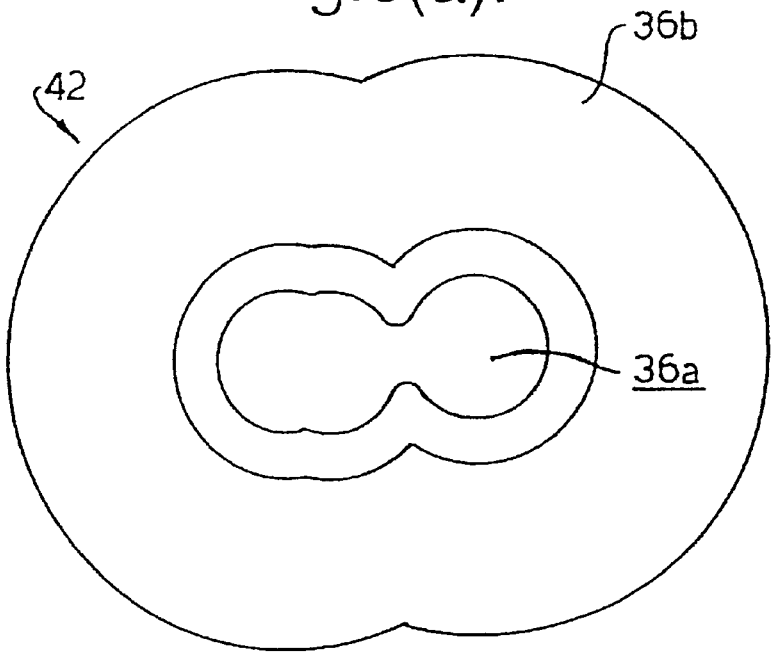
FIG. 6(*b*) shows a plan view of an electrical-contact region depicted in FIG. 5(*a*) and FIG. 6(*a*) shows an alternative configuration for the electrical-contact region.
Figure 6B:
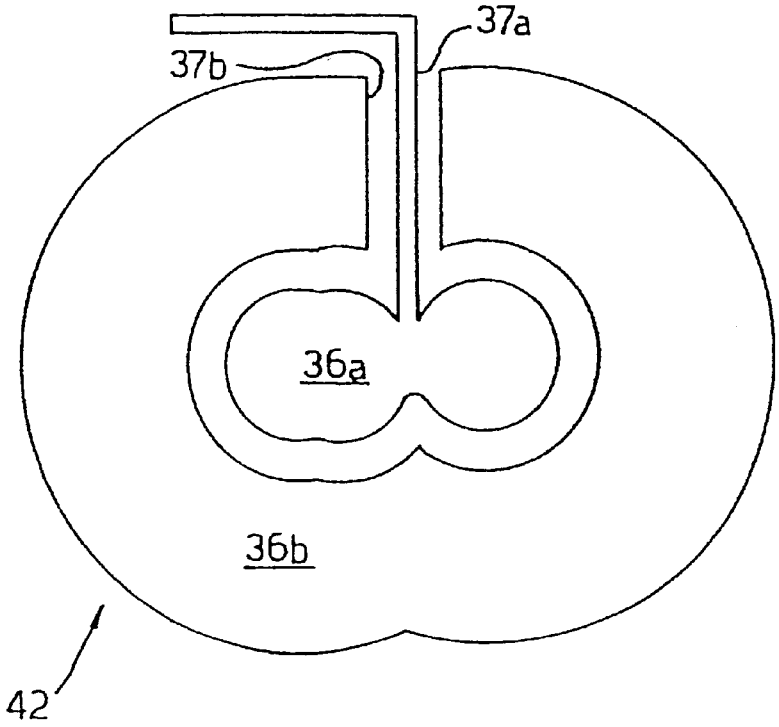

FIG. 6(*a*) shows an alternative configuration for the electrical contact region 42. This alternative configuration behaves functionally (so far as the operation of the key 16 is concerned) in a manner identical to that of the FIG. 6(*b*) configuration. However, the FIG. 6(*b*) configuration differs structurally in that the outer pad 36*b*, completely surrounds the inner pad 36*a*. Electrical connection of the inner pad to the rest of the circuitry is effected by means of vias formed in the circuit board 40.

Figure 7A:
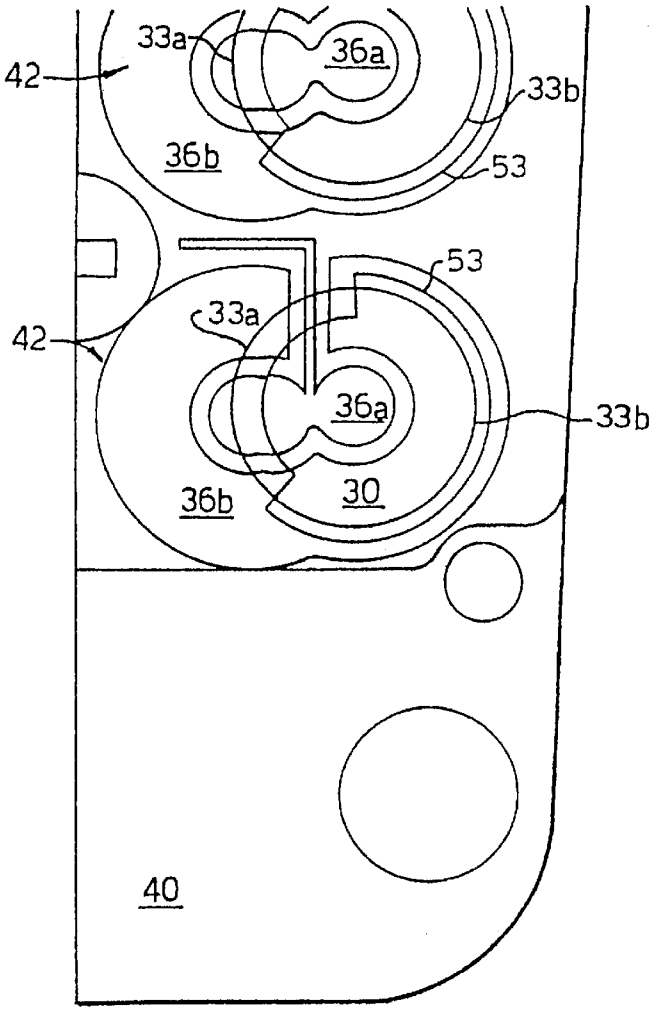
FIGS. 7(*a*), (*b*) show schematic plan view of different keypads in accordance with the invention with different key spacings achieved using the same underlying circuit board.
Figure 7A:
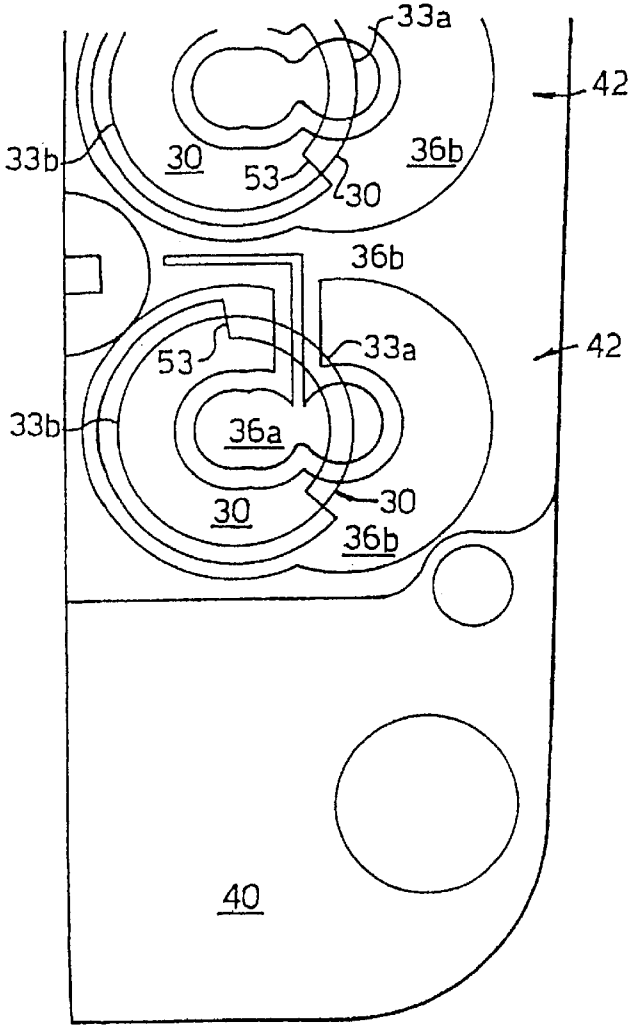

FIGS. 7(*a*) and 7(*b*) illustrate how two circuit boards 40 having the same pattern of electrical contact-regions 42 formed on them can be used in the realisation of two significantly different keypad layouts.

In other embodiments, the adhesive layer 56 can include an array of apertures (not shown) which allow the projections 22 to act directly on the summit portions 32 of the contact elements 30.

What is claimed is:

1. A method of constructing assemblies for keypads with different key layouts using substrates each having a same pattern of electrical-contact regions formed thereon and domed contact elements, the electrical-contact regions having first portions and at least one electrical-contact region of the electrical-contact regions having at least first and second electrically connected portions, the method comprising the steps of:

(i) selecting a first design of the key layouts;

(ii) providing a first insulating layer having a plurality of apertures dependent on the first design of the key layouts;

(iii) mounting the domed contact elements to confront corresponding ones of said electrical-contact regions of a first of said substrates with the first insulating layer disposed therebetween, so that each of said domed contact elements is in register with a corresponding one of said apertures and confronts a first portion of a corresponding one of said electrical-contact regions through a corresponding one of said apertures, thereby to produce an assembly having the first design of a key layout;

(iv) selecting a second design of the key layouts, the second design of the key layouts being different from the first design of the key layouts;

(v) providing a second insulating layer having a plurality of apertures dependent on the second design of the key layouts; and (vi) mounting the domed contact elements to confront corresponding ones of said electrical-contact regions of a second of said substrates with the second insulating layer disposed therebetween, so that each of said domed contact elements is in register with a corresponding one of said apertures, wherein at least one of said domed contact elements confronts second portions of a corresponding one of said electrical-contact regions, thereby to produce an assembly having the second design of the key layouts.

2. A method as claimed in claim 1, wherein an area of at least one of said electrical-contact regions is greater than an area enclosed by a footprint of a corresponding one of said domed contact elements.

3. An assembly as in claim 2, wherein electrical connection between the first and second electrical terminals is effected by a section of a rim of the corresponding one of the domed contact elements and the summit portion.

4. An assembly as in claim 2, wherein electrical connection between the first and second electrical terminals is effected by the summit portion of the corresponding one of the domed contact elements.

5. A method as claimed in claim 1, wherein an area of each of said electrical-contact regions is greater than an area enclosed by a footprint of a corresponding one of said domed contact elements.

6. An assembly for a keypad, comprising:

a substrate having a plurality of electrical-contact regions, each of the electrical-contact regions being defined by a first electrical terminal and a second electrical terminal wherein at least one of said electrical-contact regions has a first electrical terminal having at least first and second electrically connected portions and a second electrical terminal having at least first and second electrically connected portions;

an array of domed contact elements, each of the domed contact elements being mounted to confront a corresponding one of said electrical-contact regions and overlie a corresponding one of a plurality of apertures;

an insulating layer disposed between the substrate and the domed contact elements and including plural ones of said apertures arranged in one of the plurality of possible configurations, each of said apertures corresponding to one of said electrical-contact regions and exposing portions of the first and second electrical terminals of corresponding ones of said electrical-contact regions, each of said domed contact elements being depressible from a first natural bias position to a second distorted position in which a summit portion of said domed contact element passes through said corresponding one of said apertures to contact said corresponding one of said electrical-contact regions, thereby to establish electrical connection between the first and second electrical terminals of the corresponding one of said electrical-contact regions, wherein the first and second electrical terminals of the electrical-contact regions are arranged, so that for a first configuration of said apertures, the first electrically connected portions of the first and second electrical terminals of each of said electrical-contact regions are electrically connected on depression of a corresponding one of said domed elements and so that for a second configuration of said apertures in which at least one of said apertures and corresponding domed contact element have been re-positioned, the second electrically connected portions of the first and second electrical terminals of the electrical-contact regions corresponding to the re-positioned domed contact element are electrically connected on depression of the repositioned domed contact element.

7. An assembly as in claim 6, wherein electrical connection between the first and second electrical terminals is effected by a summit portion of one of said domed contact elements.

8. An assembly as in claim 6, wherein electrical connection between the first and second electrical terminals is effected by a summit portion of one of said domed contact elements.

9. An assembly as in claim 6, wherein an area of at least one of the electrical-contact regions is greater than the area enclosed by a footprint of a corresponding one of said domed contact elements.

10. An assembly as in claim 6, wherein an area of each of an electrical-contact regions is greater than the area enclosed by a footprint of a corresponding one of said domed contact elements.

11. Apparatus comprising:

first and second assemblies for a keypad, using first and second substrates of a common design, wherein each of the substrates has a plurality of electrical-contact regions, each of the regions being defined by a first electrical terminal and a second electrical terminal where at least one of the electrical-contact regions has an area greater than an area enclosed by a footprint of a corresponding one of a plurality of domed contact elements in the first and second assemblies, wherein said first assembly comprises:

the first substrate, an array of said domed contact elements in a first configuration, each of the domed contact elements being mounted to confront a corresponding one of the electrical-contact regions of the first substrate and overlie a corresponding one of a plurality of apertures, an insulating layer disposed between the first substrate and the domed contact elements and including a plurality of said apertures arranged in the first configuration, each of said apertures corresponding to one of the electrical-contact regions, each of the domed contact element being depressible from a first natural bias position to a second distorted position in which a summit portion of each of the dome contact elements passes through a corresponding one of the apertures to contact a corresponding one of the electrical-contact regions, thereby to establish electrical connection between the first and second electrical terminals of the corresponding one of the electrical-contact regions, and wherein said second assembly comprises:

the second substrate, an array of said domed contact elements in a second configuration, each of the domed contact elements being mounted to confront a corresponding one of the electrical-contact regions of the second substrate and overlie a corresponding one of a plurality of apertures, an insulating layer disposed between the second substrate and the domed contact elements and including a plurality of said apertures arranged in the second configuration, each of said apertures corresponding to one of the electrical-contact regions, each of the domed contact elements being depressible from a first natural bias position to a second distorted position in which a summit portion of the domed contact element passes through a corresponding one of the apertures to contact a corresponding one of the electrical-contact regions, thereby to establish electrical connection between the first and second electrical terminals of the corresponding one of the electrical-contact regions.

12. A method of constructing assemblies for keypads with different key layouts using substrates each having a same pattern of electrical-contact regions formed thereon and domed contact elements, the method comprising the steps of:

(i) selecting a first design of the key layouts;

(ii) providing a first insulating layer having a plurality of apertures dependent on the first design of the key layouts;

(iii) mounting the domed contact elements to confront corresponding ones of said electrical-contact regions of a first of said substrates with the first insulating layer disposed therebetween, each of said plurality of apertures being in register with one of said domed contact elements, thereby to produce an assembly having the first design of the key layouts;

(iv) selecting a second design of the key layouts, the second design of the key layouts being different from the first design of the key layouts;

(v) providing a second insulating layer having a plurality of apertures dependent on the second design of the key layouts; and (vi) mounting the domed contact elements to confront corresponding ones of said electrical-contact regions of a second of said substrates with the second insulating layer disposed therebetween, each of said apertures of said second layer being in register with one of said domed contact elements, thereby to produce an assembly having the second design of the key layouts.

13. An assembly for a keypad, comprising:

a substrate having a plurality of electrical-contact regions, each being defined by a first electrical terminal and a second electrical terminal;

an array of domed contact elements, the domed contact elements being mounted to confront a corresponding one of said electrical-contact regions and overlie only a portion thereof; and an insulating layer disposed between the substrate and the domed contact elements and including a plurality of apertures, each of said apertures corresponding to one of said electrical-contact regions, wherein each of the domed contact elements being depressible from a first natural bias position to a second distorted position in which a summit portion of each of the domed contact elements passes through a corresponding one of the apertures to contact a corresponding one of the electrical-contact regions, thereby to establish electrical connection between the first and second electrical terminals of the corresponding one of the electrical-contact regions.

14. An assembly as in claim 13, wherein an area of each of the electrical-contact regions is greater than an area enclosed by a footprint of the corresponding one of the domed contact elements.

15. An assembly as in claim 14, wherein electrical connection between the first and second electrical terminals is effected by a section of a rim of the corresponding one of the domed contact elements and the summit portion.

16. An assembly as in claim 14, wherein electrical connection between the first and second electrical terminals is effected by the summit portion of a domed contact element.

17. An assembly as in claim 13, wherein electrical connection between the first and second electrical terminals is effected by a section of a rim of the corresponding one of the domed contact elements and the summit portion.

18. An assembly as in claim 13, wherein electrical connection between the first and second electrical terminals is effected by the summit portion of a domed contact element.

* * * * *